US011433274B1

(12) United States Patent
Lagree et al.

(10) Patent No.: US 11,433,274 B1
(45) **Date of Patent: *Sep. 6, 2022**

(54) EXERCISE MACHINE WITH MULTIPLE PLATFORMS

(71) Applicant: Lagree Technologies, Inc., Burbank, CA (US)

(72) Inventors: Sebastien Anthony Louis Lagree, Burbank, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 388 days.

This patent is subject to a terminal disclaimer.

(21) Appl. No.: 16/792,404

(22) Filed: Feb. 17, 2020

Related U.S. Application Data

(63) Continuation of application No. 16/008,232, filed on Jun. 14, 2018, now Pat. No. 10,561,896.
(Continued)

(51) Int. Cl.
*A63B 22/20* (2006.01)
*A63B 21/00* (2006.01)
(Continued)

(52) U.S. Cl.
CPC ..... *A63B 22/203* (2013.01); *A63B 21/4031* (2015.10); *A63B 21/4035* (2015.10);
(Continued)

(58) Field of Classification Search
CPC ..... A63B 22/203; A63B 21/4031; A63B 21/4035; A63B 22/0089; A63B 22/16;
(Continued)

(56) References Cited

U.S. PATENT DOCUMENTS 1,621,477 A 8/1925 Pilates
3,770,267 A 11/1973 McCarthy
(Continued)

FOREIGN PATENT DOCUMENTS

WO WO 2004/096376 11/2004

*Primary Examiner* — Erin Deery
*Assistant Examiner* — Christian R Rodriguez
(74) *Attorney, Agent, or Firm* — Neustel Law Offices

(57) ABSTRACT

An exercise machine with multiple platforms for an exerciser to perform a variety of exercises generally includes an elongated frame structure supporting stationary first and second end platforms, a longitudinal rail extending between the end platforms and having an upper surface comprising a central platform, and a slideable carriage platform that reciprocates on the rail over the central platform and between the end platforms. The platforms provide multiple support surfaces at multiple elevations on which exercisers can position parts of their bodies during exercise. The platforms may be provided with positioning indices and provide continuous support surfaces over substantially the entire length of the exercise machine. The central platform may be provided with finger grips for exercisers to grasp. One or more mounting platforms may be provided to facilitate mounting and dismounting of the exercise machine.

20 Claims, 11 Drawing Sheets

Related U.S. Application Data

(60) Provisional application No. 62/519,618, filed on Jun. 14, 2017.

(51) Int. Cl.

| | |
|---|---|
| ***A63B 22/16*** | (2006.01) |
| ***A63B 22/00*** | (2006.01) |
| ***A63B 21/04*** | (2006.01) |
| ***A63B 21/02*** | (2006.01) |
| *A63B 71/06* | (2006.01) |

(52) U.S. Cl.
CPC ..... *A63B 22/0089* (2013.01); *A63B 22/16* (2013.01); *A63B 21/00065* (2013.01); *A63B 21/023* (2013.01); *A63B 21/0428* (2013.01); *A63B 22/0087* (2013.01); *A63B 2071/0694* (2013.01)

(58) Field of Classification Search
CPC . A63B 71/06; A63B 21/00065; A63B 21/023; A63B 21/0428; A63B 2071/0694; A63B 21/02; A63B 21/022; A63B 21/025; A63B 22/0087; A63N 23/1236; A63N 23/1245
See application file for complete search history.

(56) References Cited

U.S. PATENT DOCUMENTS

| | | | | |
|---|---|---|---|---|
| 4,759,540 | A | 7/1988 | Yu | |
| 4,798,378 | A | 1/1989 | Jones | |
| 5,066,005 | A | 11/1991 | Luecke | |
| 5,263,913 | A | 11/1993 | Boren | |
| 5,328,427 | A * | 7/1994 | Sleamaker | A63B 69/0022 482/110 |
| D362,700 | S | 9/1995 | Breibart | |
| D382,319 | S | 8/1997 | Gerschefske | |
| 5,681,249 | A | 10/1997 | Endelman | |
| 5,885,197 | A | 3/1999 | Barton | |
| 5,967,955 | A | 10/1999 | Westfall | |
| 6,179,753 | B1 | 1/2001 | Barker | |
| 7,163,500 | B2 | 1/2007 | Endelman | |
| 7,294,100 | B2 | 11/2007 | Bull | |
| 7,438,673 | B1 * | 10/2008 | Jones | A63B 23/0488 482/907 |
| 7,803,095 | B1 | 9/2010 | Lagree | |
| 7,931,570 | B2 | 4/2011 | Hoffman | |
| 8,100,815 | B2 | 1/2012 | Balaker | |
| 8,641,582 | B2 | 2/2014 | Ahmadi Mirghaed | |
| 8,961,373 | B2 | 2/2015 | Halver | |
| 9,028,374 | B1 * | 5/2015 | Brady | A63B 22/16 482/72 |
| 9,079,071 | B2 * | 7/2015 | Allain | A63B 21/0428 |
| 9,199,112 | B2 | 12/2015 | Chen | |
| 9,492,705 | B2 | 11/2016 | Hong | |
| 9,981,156 | B2 | 5/2018 | Lagree | |
| 10,143,882 | B2 | 12/2018 | Lagree | |
| 10,201,724 | B2 | 2/2019 | Lagree | |
| 10,238,910 | B2 | 3/2019 | Lagree | |
| 10,369,398 | B2 | 8/2019 | Lagree | |
| 10,561,896 | B2 * | 2/2020 | Lagree | A63B 22/203 |
| 10,857,418 | B2 * | 12/2020 | Lagree | A63B 21/4047 |
| 2001/0056011 | A1 | 12/2001 | Endelman | |
| 2003/0119635 | A1 | 6/2003 | Arbuckle | |
| 2005/0164856 | A1 | 7/2005 | Parmater | |
| 2006/0046914 | A1 | 3/2006 | Endelman | |
| 2006/0199712 | A1 | 9/2006 | Barnard | |
| 2008/0070765 | A1 | 3/2008 | Brown | |
| 2008/0248935 | A1 | 10/2008 | Solow | |
| 2010/0227748 | A1 | 9/2010 | Campanaro | |
| 2011/0143898 | A1 | 6/2011 | Trees | |
| 2011/0166002 | A1 | 7/2011 | Savsek | |
| 2011/0172069 | A1 | 7/2011 | Gerschefske | |
| 2012/0295771 | A1 | 11/2012 | Lagree | |
| 2014/0011645 | A1 | 1/2014 | Johnson | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 * | 12/2015 | Lagree | A63B 23/0222 482/121 |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0043210 | A9 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0229071 | A1 * | 8/2018 | Endelman | A63B 22/0087 |
| 2018/0280782 | A1 | 10/2018 | Lagree | |
| 2019/0083842 | A1 | 3/2019 | Lagree | |

(56) References Cited

U.S. PATENT DOCUMENTS

| | | | | |
|---|---|---|---|---|
| 2019/0134459 | A1* | 5/2019 | Locchead | A63B 21/00065 |
| 2019/0247707 | A1 | 8/2019 | Lagree | |

* cited by examiner

EXERCISE MACHINE WITH MULTIPLE PLATFORMS

CROSS REFERENCE TO RELATED APPLICATIONS

The present application is a continuation of U.S. application Ser. No. 16/008,232 filed on Jun. 14, 2018 which issues on Feb. 18, 2020 as U.S. Pat. No. 10,561,896, which claims priority to U.S. Provisional Application No. 62/519,618 filed Jun. 14, 2017. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to the field of exercise equipment and more particularly to an exercise machine with multiple platforms upon which an exerciser may perform a variety of exercises.

Related Art

Any discussion of the related art throughout the specification should in no way be considered as an admission that such related art is widely known or forms part of common general knowledge in the field.

Exercise machines in general have been commercially available for many decades, and are well known to those in the fitness industry. It is also well known that in general exercise machines have historically been designed and engineered to allow specific exercises to be performed on them. In most instances, a single user point of contact is recommended for use of most exercise machines. In other words, some exercise machines require an exerciser to sit on a platform while performing arm or leg exercises. Other machines require the exerciser to lay upon a platform long enough to substantially support the full length of a torso.

These approaches to dedicated-use exercise equipment design have served the industry well as far as they go, but dedicated-use exercise machines severely limit the flexibility of any given piece of exercise equipment, preventing it from being used for multiple exercises.

Commercial fitness businesses understand that exercise machines represent significant investment, and further, that exercise specific equipment requires a substantially larger facility in order to accommodate the multiple pieces of equipment needed to provide a complete workout, yet another cost-related item when considering dedicated-use equipment.

Those skilled in the art would appreciate the commercial value of exercise equipment that can be used for a wide variety of exercises by exercisers of various sizes, and the user advantages of using the same familiar exercise machine for a variety of different exercises. Such a machine would be required to provide for multiple exercise platforms and multiple points of contact between exerciser and machine.

SUMMARY

Example embodiments are directed to an exercise machine with a plurality of exercise platforms that may be used by exercisers to perform a wide variety of exercises. An example machine generally comprises an elongated frame with first and second ends, and a rail extending substantially between the first and second ends. First and second end platforms are positioned on the frame and a carriage is positioned on the rail. The carriage is movable in a reciprocating manner between the first and second end platforms. The rail has an upper surface that comprises a central platform.

The central platform, first and second end platforms, and carriage have upper surfaces on which an exerciser can position a part of the exerciser's body during exercise. In a preferred arrangement, the central platform, carriage and first and second end platforms are arranged to provide support for an exerciser over substantially the entire length and width of the exercise machine.

The central platform may be elongated and relatively narrow compared to the carriage and first and second end platforms, and may have a substantially flat and planar upper surface. The upper surface may extend substantially the entire length between the first and second end platforms. Finger holds may be provided for an exerciser to grasp during exercise.

The central platform may include a plurality of spaced index indicators to facilitate proper positioning of the carriage relative to the central platform for various exercises. The carriage and the first and second end platforms also have spaced apart index indicators to indicate a plurality of positions for an exerciser to place a part of the exerciser's body. The indicators of the central platform, the carriage, and the first and second end platforms may be aligned and extend substantially the entire length of the exercise machine between the first and second ends of the frame.

The central platform may comprise a single elongated platform extending along the rail substantially from the first end platform to the second end platform. Alternatively, the central platform may comprise a plurality of platform segments or sections.

The upper surfaces of the carriage and the first and second end platforms may be arranged in a common plane at a first elevation relative to the frame. The upper surface of the central platform may comprise a second plane at a second elevation relative to the frame.

One or more mounting platforms may be attached to the frame to facilitate exercisers mounting and dismounting the exercise machine. The mounting platforms may be located near the first and/or second end platforms on one or both opposite lateral sides of the frame and may have upper surfaces at a third elevation relative to the frame.

There has thus been outlined, rather broadly, some example embodiments of an exercise machine with multiple platforms in order that the detailed description thereof may be better understood, and in order that the present contribution to the art may be better appreciated. There are additional embodiments that will be described hereinafter and that will form the subject matter of the claims appended hereto. In this respect, before explaining at least one embodiment in detail, it is to be understood that the exercise machine with multiple platforms is not limited in its application to the details of construction or to the arrangements of the components set forth in the following description or illustrated in the drawings. The exercise machine with multiple platforms is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
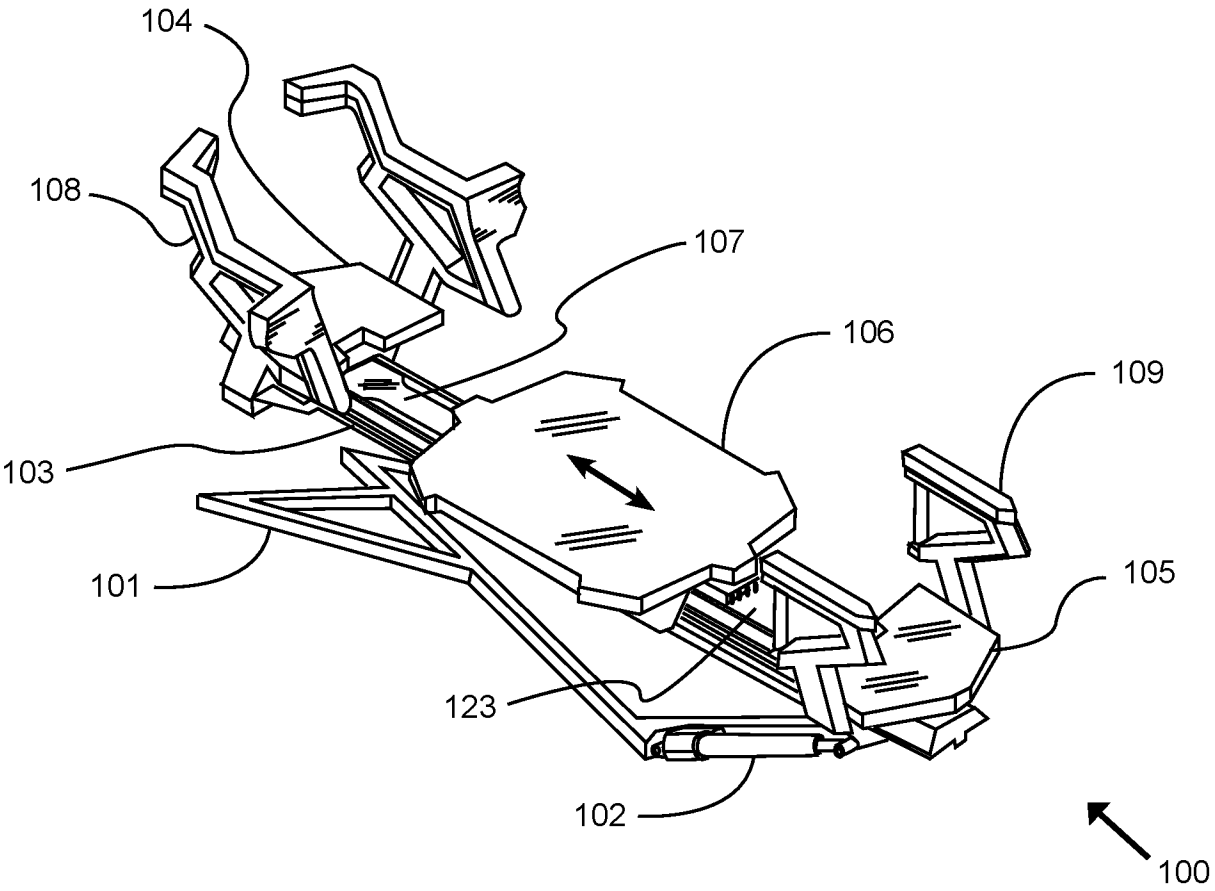
FIG. 1 is an isometric view of an exercise machine with multiple exercise platforms in accordance with an example embodiment.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The words "example" and "exemplary" are used herein to mean "serving as an example, instance, or illustration." Any embodiment described herein as an "example" or as "exemplary" is not necessarily to be construed as preferred or advantageous over other embodiments.

A. Overview.

An example exercise machine with multiple platforms generally comprises an elongated frame having a first and second ends, and a rail structure extending substantially between the first and second ends. The rail structure has an upper surface that comprises a longitudinal central platform on which an exerciser can position a part of the exerciser's body during exercise.

First and second stationary end platforms are positioned on the frame near the first and second ends of the frame respectively. A movable carriage platform is positioned on the rail structure and is movable in a reciprocating manner between the first and second end platforms preferably over the central platform. The central platform, first and second end platforms, and carriage have upper surfaces on which an exerciser can position a part of the exerciser's body during exercise. One or more biasing members of varying levels of resistance, as may be preferred by an exerciser during a workout, are connected to the carriage platform to selectively apply a bias force for resistance training. In a preferred arrangement, the central platform, carriage platform and first and second end platforms extend substantially the entire length between the first and second ends of the frame to provide support for an exerciser over substantially the entire length and width of the exercise machine.

Preferred features of the central platform include that it is elongated and relatively narrow compared to the carriage and first and second end platforms, that it has a substantially flat and planar upper surface, and that the upper surface extends substantially the entire length between the first and second end platforms. Another preferred feature is the inclusion of finger grips on opposite lateral sides for an exerciser to grasp during exercise.

Still another preferred feature is the inclusion of a plurality of spaced index indicators to facilitate proper positioning of the carriage relative to the central platform for various exercises. In one embodiment, the carriage and the first and second end platforms also have spaced apart index indicators to indicate a plurality of positions for an exerciser to place a part of the exerciser's body. Preferably, the indicators of the central platform, the carriage platform, and the first and second end platforms are aligned and extend substantially the entire length of the exercise machine between the first and second ends of the frame.

In one embodiment, the central platform can comprise a single elongated platform extending along the rail structure substantially from the first end platform to the second end platform. In another embodiment, the central platform may comprise a plurality of platform sections or segments.

In a preferred arrangement, the upper surfaces of the carriage platform and the first and second end platforms are arranged in a common plane at a first elevation relative to the frame. The upper surface of the central platform comprises a second plane at a second elevation relative to the frame and the second elevation is less than the first elevation.

In one embodiment, one or more mounting platforms are attached to the frame and facilitate exercisers mounting and dismounting the exercise machine. In a preferred arrangement, mounting platforms are located near the first and second end platforms on opposite lateral sides of the frame. The mounting platform or platforms preferably are mounted to the frame at a third elevation relative to the frame that is less than the second elevation.

B. Machine Components Generally.

Referring initially to FIG. 1, an example exercise machine 100 is supported on an elongated frame support structure having a first end and a second end. The frame structure comprises an elongated structural base 101, a universal joint 110, a pair of actuators 102, and preferably one or more pivot arms. The universal joint is mounted on the base near the first end. The universal joint is obscured in FIG. 1, but is illustrated in other Figures. The actuators and one or more pivot arms are mounted on the base near the opposite second end. One actuator is positioned on each opposing lateral side of the exercise machine. The elongated frame support structure just described supports a primary longitudinal rail structure 103 that extends substantially between the first and second ends. The rail structure comprises a monorail structure with an open interior cavity that contains one or more resistance biasing members, and a pair of parallel rails, later described, that guide the reciprocal motion of a slideable carriage platform.

The machine provides for a plurality of exercise platforms, specifically at least a first stationary front end platform 104, a second slideable carriage platform 106, a third stationary back end platform 105, and a longitudinal central platform comprising a fourth front platform 107, and a fifth back platform 123.

Additional points of exerciser contact include handle assemblies that provide smaller platform areas to support forearms and hands during exercise, specifically a pair of front handle assemblies 108 and a pair of back handle assemblies 109. Each pair of handle assemblies just described comprises a left and right handle opposed to each other and substantially aligned with, but positioned transverse to, the longitudinal axis of the exercise machine.

C. Multiple Stationary and Movable Exercise Platforms.

Referring primarily to FIGS. 2-6, the example exercise machine has multiple stationary exercise platforms and at least one slideable carriage exercise platform. In FIGS. 2A and 2B, it should be noted that the structural base, actuators and handle assemblies of the machine are represented by dashed lines as a means of directing attention to the primary multiple platforms.

Figure 2B:
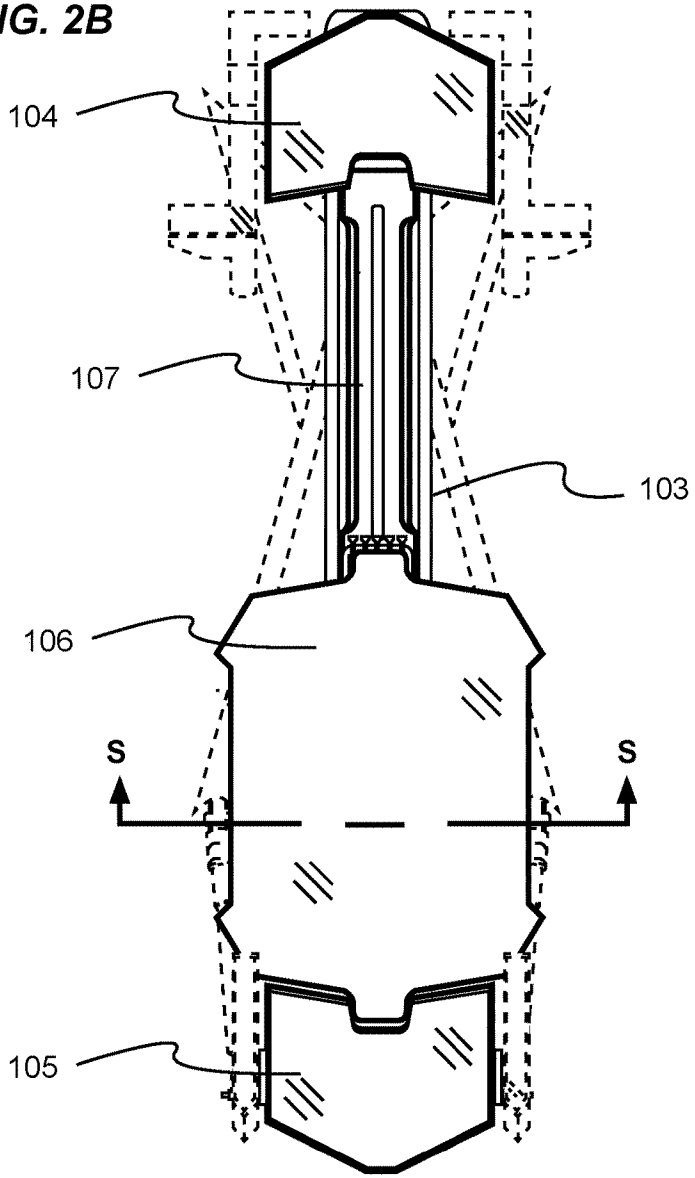
FIG. 2B is a top view of an exercise machine with multiple stationary exercise platforms and at least one slideable exercise platform moved to a different position in accordance with an example embodiment.
Figure 2A:
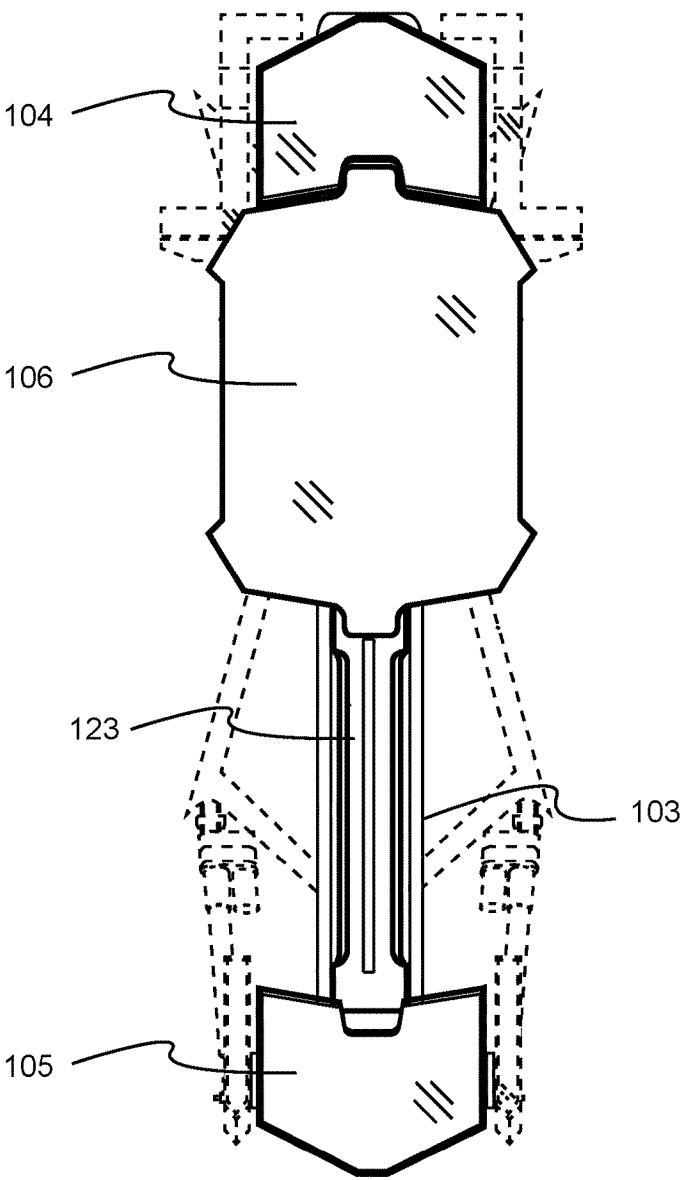
FIG. 2A is a top view of an exercise machine with multiple stationary exercise platforms and at least one slideable exercise platform in one position in accordance with an example embodiment.

Referring primarily to FIG. 2A, the example exercise machine has a first stationary front end platform 104, a second slideable carriage platform 106 positioned proximate to the front end platform, a third stationary back end platform 105, and a longitudinal central platform comprising a fifth back central platform 123, all of which are either affixed or movably attached as described to a primary longitudinal rail structure 103. Exercisers may therefore use any one or a combination of any of the platforms just described for performing exercises.

FIG. 2B illustrates an example exercise machine with multiple stationary platforms and at least one slideable carriage platform 106 moved to a different position than shown in FIG. 2A. The exercise machine has a first stationary front end platform 104, a second slideable carriage platform 106 that has been repositioned towards the back of the machine, thereby exposing a fourth front central platform 107 of the longitudinal central platform, and a third stationary back end platform 105, all of which are affixed or movably attached to primary longitudinal rail structure 103. As seen in FIGS. 2A and 2B, the slideable carriage platform 106 is reciprocally movable along the rail structure 103 over the longitudinal central platform substantially the entire length between the front end platform 104 and the back end platform 105. As the slideable carriage platform is repositioned on the rail structure, different sections or segments of the central platform are exposed for use by an exerciser. Additional details of the rail structure and slideable carriage platform can be seen in FIG. 7 in a sectional view taken through the cross-section line S-S and will be described more fully below.

Referring to FIGS. 3-6, an exerciser can position various parts of the exerciser's body on various combinations of the multiple exercise platforms of the example exercise machine to perform a wide variety of different exercises without the need to change to different exercise machines.

Figure 3:
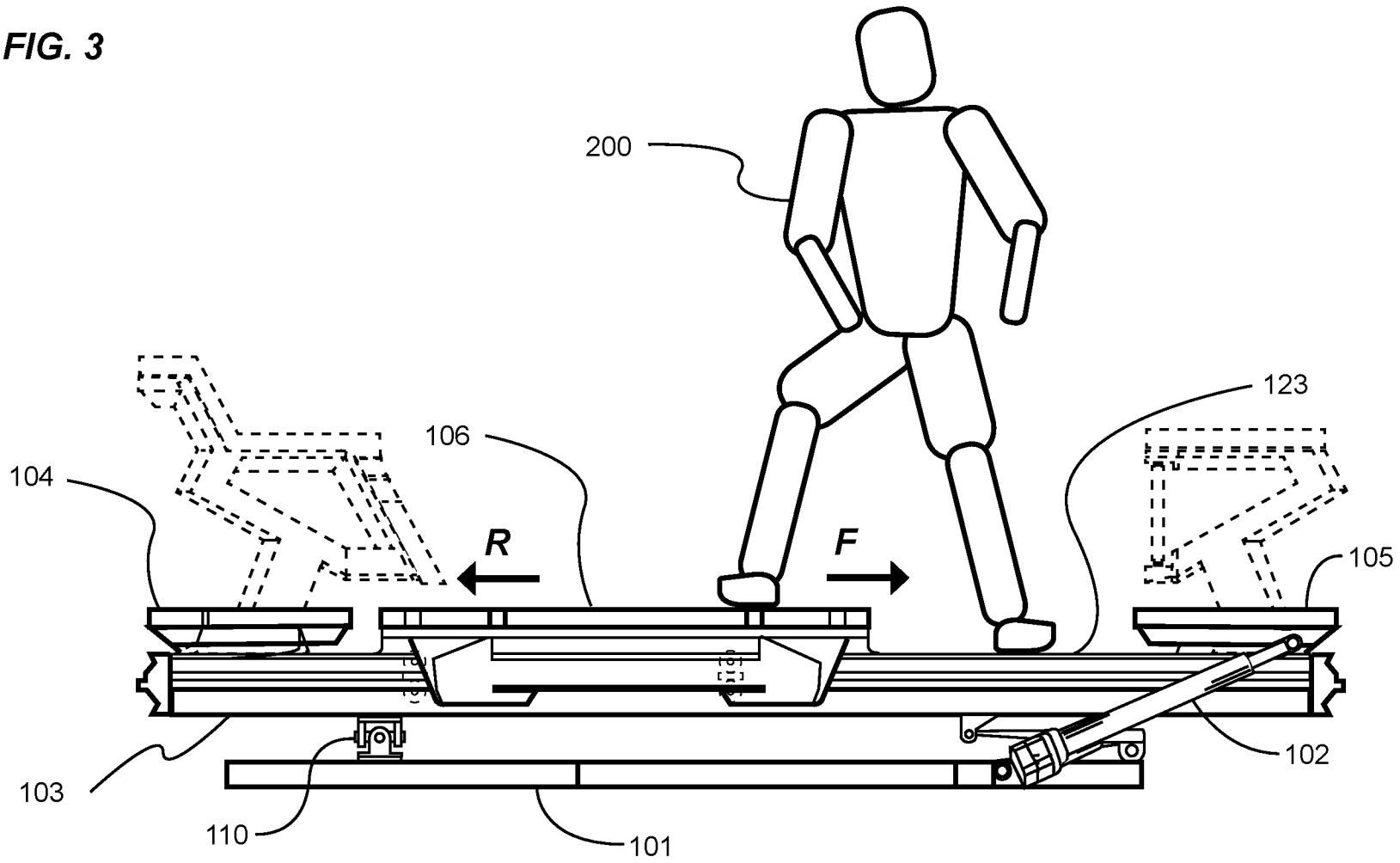
FIG. 3 is a side view of an exercise machine with multiple exercise platforms in accordance with an example embodiment with an exerciser positioned on a second movable and a fifth stationary platform.

In FIG. 3 an exerciser 200 is shown positioned on the second slideable carriage platform and the fifth back central platform of the central platform of an example exercise machine. The example exercise machine is substantially rectangular and elongated with a first end and a second end and has an elongated frame support structure comprising an elongated structural base 101. The base supports a longitudinal rail structure 103 that extends substantially the entire length between the first and second ends by means of a universal joint 110 located at or near the first end, a pair of actuators 102 at or near the second end, and one or more pivot arms located at or near the second end. Respective handle assemblies mounted to the rail structure at or near the first and second ends are shown by means of dashed lines for positional reference, and so as not to obscure visibility of any of the multiple exercise platforms.

The exercise platforms comprise a stationary front end platform 104, a slideable carriage platform 106, a longitudinal central platform comprising a back central platform 123, of which only the top substantially flat, planar, horizontal surface is visible, and a stationary back end platform 105. The slideable carriage platform is movable reciprocally over the central platform for substantially the entire length between the stationary first and second end platforms.

The exerciser 200 is positioned on the example exercise machine using two discrete platforms with the exerciser's right foot positioned on the slidable carriage platform 106 and the exerciser's left foot positioned on the back central platform 123 of the longitudinal central platform. A resistance force "R" is exerted upon the slideable carriage platform by one or more biasing members, which are not shown but which are located substantially within the cavity of the longitudinal rail structure 103. In order to perform work against the resistance force during an exercise, the exerciser will move the right foot, and correspondingly the slideable carriage platform towards the left foot, thus applying a muscle force in the direction of the "F" arrow that exceeds the resistance force "R" applied by the biasing members. The exercise is therefore performed by repeating the steps just described for a prescribed number of repetitions after returning the slideable carriage platform to a starting position.

Figure 4:
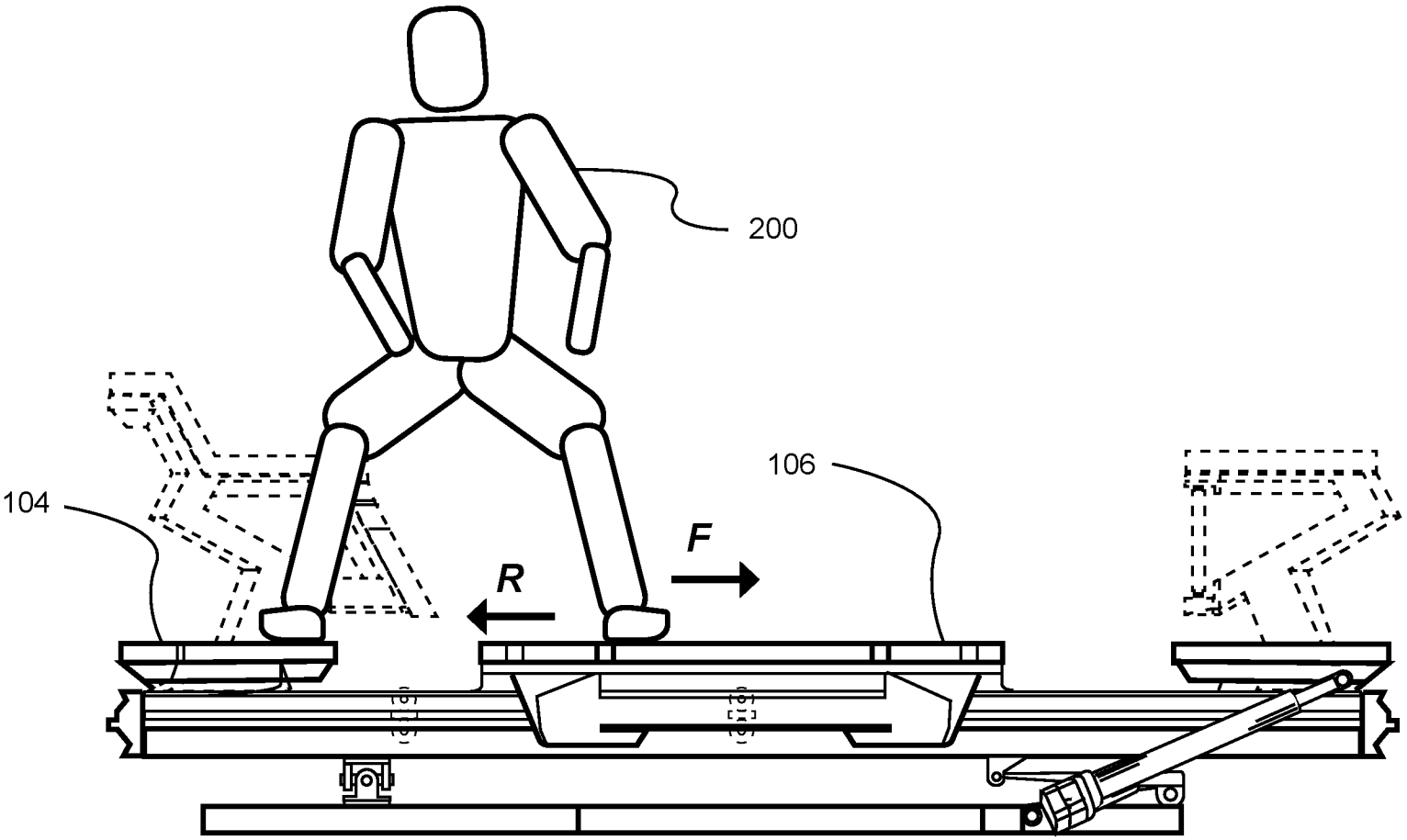
FIG. 4 is a side view of an exercise machine with multiple exercise platforms in accordance with an example embodiment with an exerciser positioned on a first stationary and a second movable platform.

Referring to FIG. 4, the exerciser 200 is positioned on the example exercise machine using a different combination of platforms, in this case two discrete platforms, with the exerciser's right foot positioned on the stationary front end platform 104 and the exerciser's left foot positioned on the slideable carriage platform 106. In order to perform work against the resistance force applied to the slideable carriage platform by the one or more biasing members, the exerciser will push the right and left foot apart against the resistance force "R" with a superior muscle force in the direction of the "F" arrow, causing the slideable carriage platform to slide away from the front stationary platform. The exercise is therefore performed by repeating the steps just described for a prescribed number of repetitions after returning the slideable carriage platform to a starting position.

Figure 5:
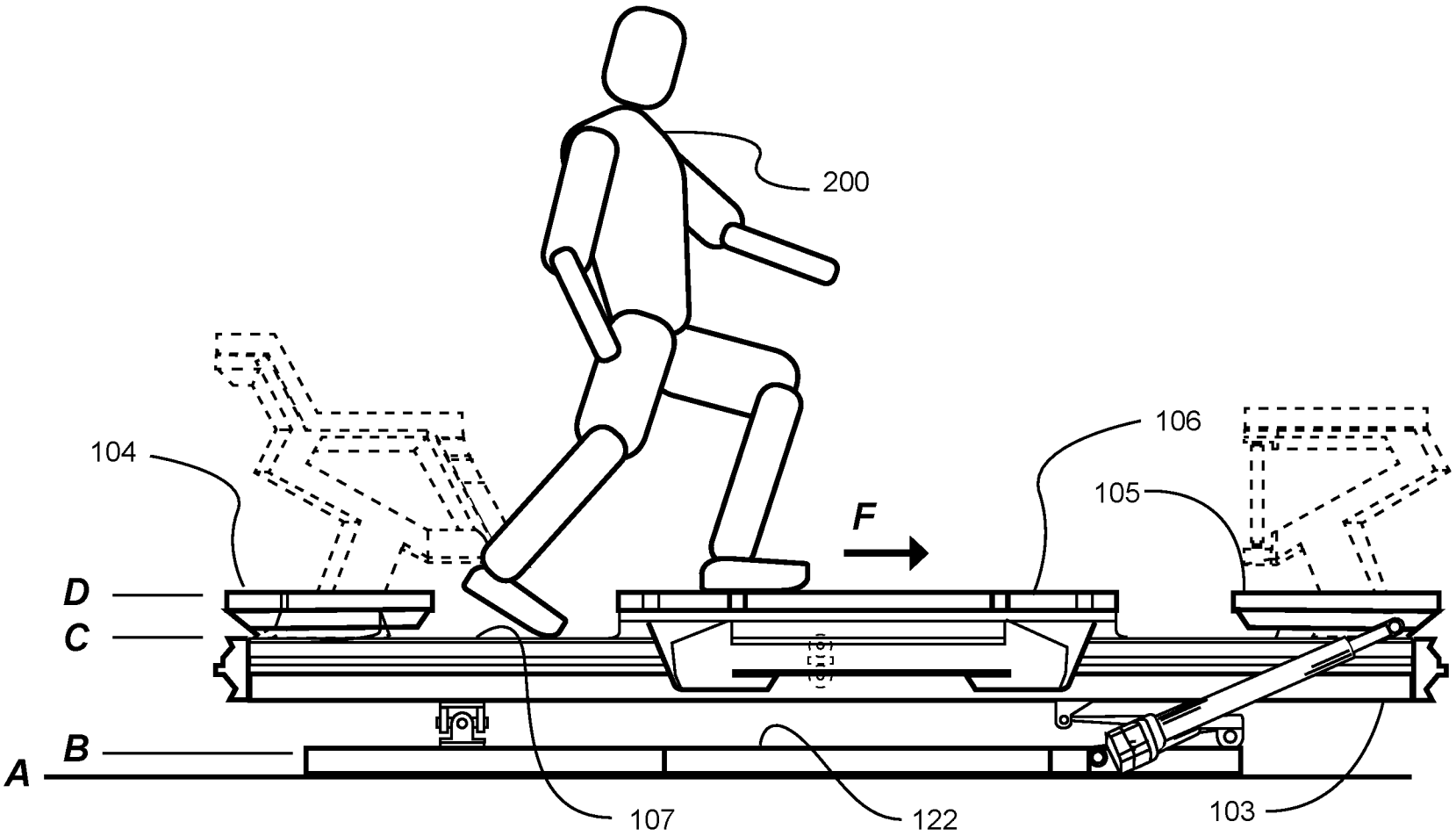
FIG. 5 is a side view of an exercise machine with multiple exercise platforms in accordance with an example embodiment with an exerciser positioned on a fourth stationary and second movable platform.

Referring to FIG. 5 the exerciser 200 is positioned on the example exercise machine using still another different combination of platforms, in this case two discrete platforms, with the exerciser's right foot positioned on the front central platform 107 of the longitudinal central platform and the exerciser's left foot positioned on the slideable carriage platform 106. In order to perform work against the resistance force applied to the slideable carriage platform by the one or more biasing members, the exerciser will push the right and left foot apart against the resistance force "R" with a superior muscle force in the direction of the "F" arrow, causing the slideable carriage platform to slide away from the front central platform and stationary front end platform. Use of the front central platform of the longitudinal central platform for the exercise shown requires the exerciser to concentrate on balance while concurrently performing a resistance exercise. The exercise is therefore performed by repeating the steps just described for a prescribed number of repetitions after returning the slideable carriage platform to a starting position.

In the drawing, a series of horizontal lines are shown to illustrate the various elevations of the multiple exercise platforms of the improved example exercise machine. More specifically, the machine as previously described rests upon a floor or other support surface at an elevation "A". The base 101 has an upper surface comprising a mounting platform 122 which is used as a means to aid in mounting the exercise machine via the universal joint 110 and other components, such as pivot arms. The elevation of the mounting platform 122 is a first vertical distance "B" above the floor or other support surface. The front and back central platforms 107, 123 of the longitudinal central platform preferably comprise substantially flat, planar upper exercise surfaces in substantially the same horizontal plane. The upper exercise surfaces are positioned approximately at an elevation plane "C" a second vertical distance above the floor or other support surface. Further, the stationary front end platform 104, slideable carriage platform 106, and stationary back end platform 105 each preferably have substantially flat planar upper surfaces in substantially the same horizontal plane. The upper surfaces are positioned approximately at an elevation plane "D" a third vertical distance above the floor or other support surface and above the elevation plane "C" of the upper surfaces of the front and back longitudinal central platforms.

It should be noted that the vertical dimensions between any of the horizontal planes of the platforms as just described are not meant to be fixed as shown or to be limiting. Rather, the various platforms may be arranged to have upper surfaces in various horizontal planes at various vertical distances above the support base and ground or other support surface as may be preferred to accommodate the mounting of the machine, and the performance of exercises upon the machine.

Figure 6:
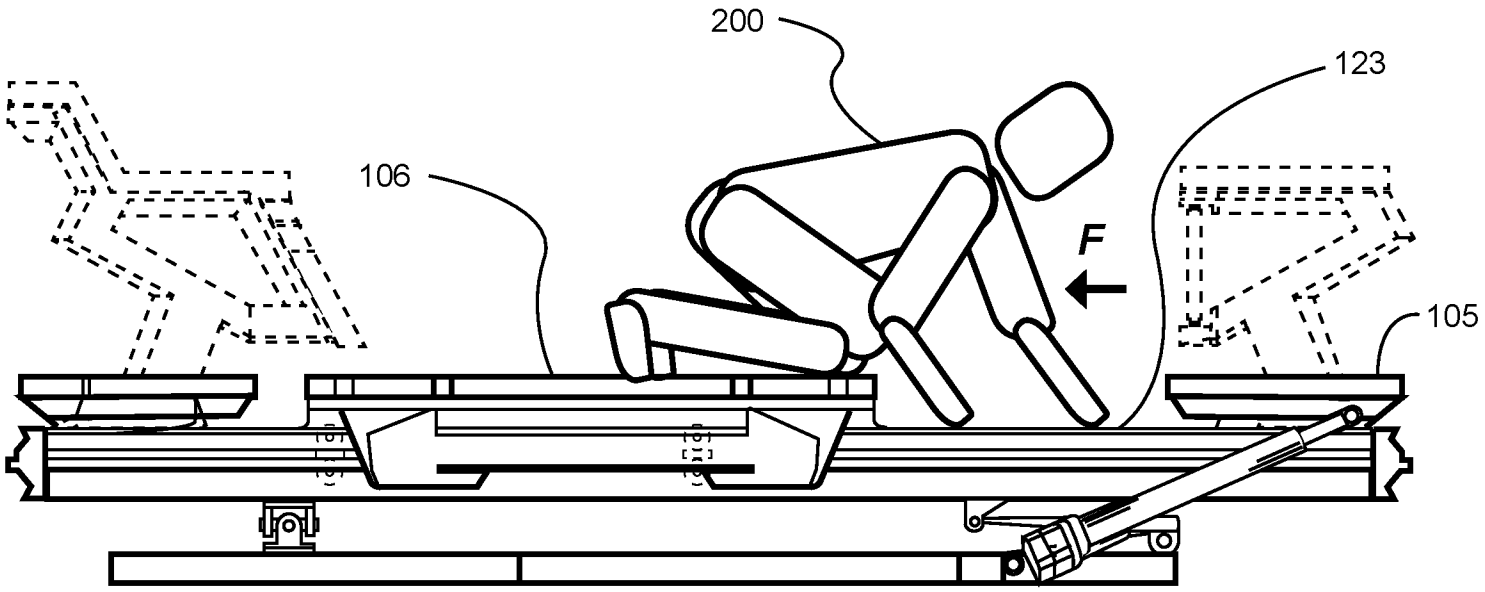
FIG. 6 is a side view of an exercise machine with multiple exercise platforms in accordance with an example embodiment with an exerciser positioned on a second movable and a fifth stationary platform.

Referring to FIG. 6, the exerciser 200 is shown positioned on the example exercise machine using yet another different combination of platforms, in this case two discrete platforms, with the exerciser first kneeling on the slideable carriage platform 106, and reaching forward to rest the exerciser's hands on the back central platform 123 of the longitudinal central platform. As described in more detail below, both the back and front central platforms preferably comprise opposite lateral sides with one or more finger grips. In order to perform work against the resistance force applied to the slideable carriage platform, the exerciser will grasp the finger grips on the opposite lateral side edges of the back central platform 123 and pull the hands toward the knees with a superior muscle force in the direction of the "F" and arrow, causing the slideable carriage platform to slide in a direction towards the stationary back end platform 105. The method used by the exerciser to grasp the finger grips of the longitudinal central platform is to insert the fingers of the exerciser's hands in a gap between the left and right lateral side edges of the longitudinal central platform and the longitudinal rail structure, and grasp one or more preferably elongated depressions or indentations in the side edges of the platform. The gap and finger grips will be more fully described below.

D. Longitudinal Central Exercise Platform.

Figure 7:
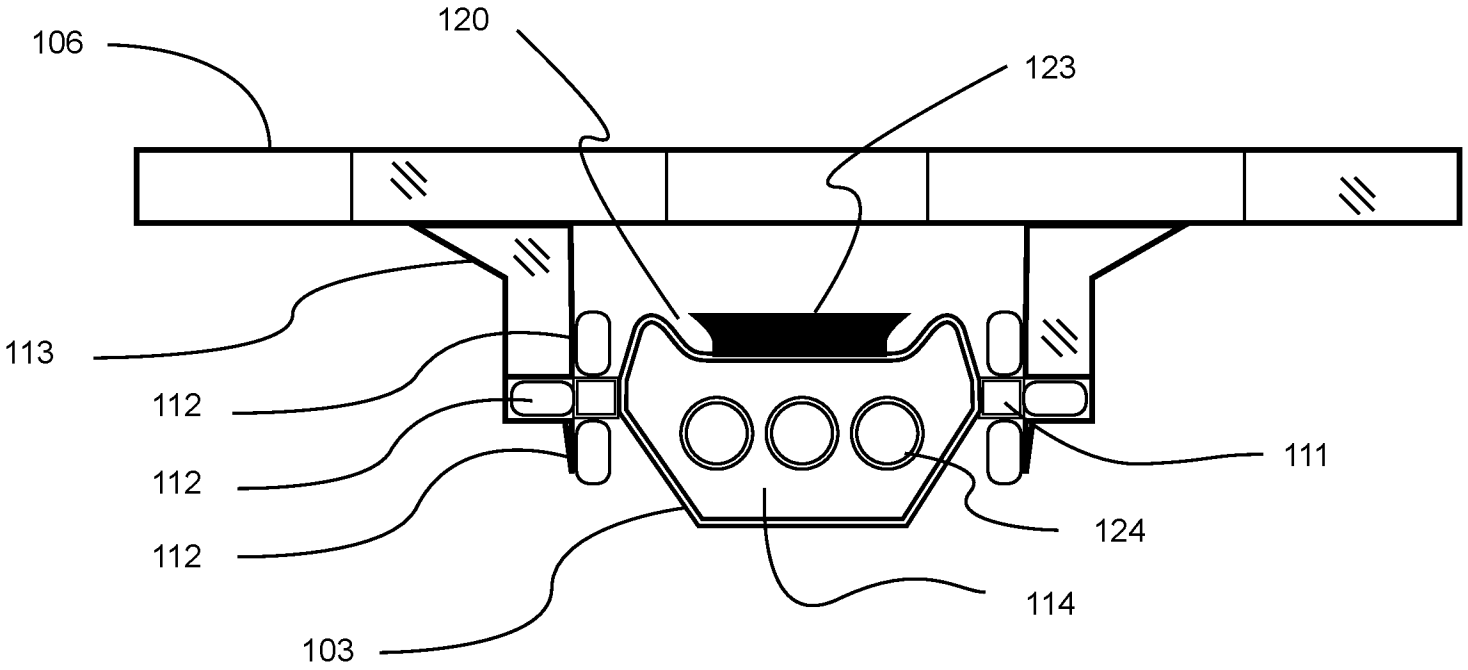
FIG. 7 is a sectional view taken along the section line S-S of FIG. 2B through a center monorail structure and two exercise platforms of an exercise machine in accordance with an example embodiment.

Referring primarily to FIG. 7, a sectional end view of the longitudinal rail structure 103, slideable carriage platform 106, and longitudinal central platform is shown taken along cross-section line S-S of FIG. 2B with the back central platform 123 of the longitudinal central platform being visible.

The longitudinal rail structure comprises a substantially hollow monorail structure that extends longitudinally substantially centrally beneath the slideable carriage platform 106 substantially the entire length between the first and second ends of the frame of the machine. Although not shown in this view, the monorail structure is mounted to the base support structure via the actuators and universal joint as previously shown and described.

The monorail structure has a pair of opposite lateral side surfaces. A pair of parallel longitudinal trolley rails 111 is affixed to the side surfaces and preferably extend substantially the length of the monorail structure. The slideable carriage platform 106 is movably supported on the pair of trolley rails by means of a plurality of trolley wheels 112 affixed to a plurality of trolley stanchions 113. The trolley wheels are in rolling engagement with the pair of trolley rails and the stanchions are affixed to the underside of the slideable carriage platform. Thus, by exerting a force against the slideable carriage platform 106 in a direction substantially parallel to the longitudinal axis of the trolley rails 111, the slideable platform will move in the direction of the force a distance preferably not exceeding the distance between the first and third stationary end platforms as previously described.

In this end view, a plurality of biasing members 124, for instance, extension springs, can be seen within the cavity 114 of the longitudinal hollow monorail structure. Although not shown, those skilled in the art will recognize that a first end of the plurality of biasing members would be affixed to a stationary member of the longitudinal structure, and the second end of the biasing members would be removably attached to the slideable carriage platform 106, thereby exerting a resistance force upon the slideable carriage platform corresponding to the force created by the one or more biasing members attached to the slideable carriage platform.

The monorail structure of the longitudinal rail structure 103 has an upper surface. The upper surface comprises the longitudinal central platform. In the end view of FIG. 7 only the back central platform 123 of the central platform is visible. The longitudinal central platform may be formed as an integral part of the upper surface or may be a separate piece mounted thereto. The central platform may comprise a contiguous piece extending longitudinally over a portion or substantially the entire length of the upper surface of the rail structure. Alternatively, the central platform may comprise a plurality of sections or segments spaced along the length of the upper surface of the rail structure. Thus, when the front and back central platforms 107, 123 of the longitudinal central platform are described herein, it will be understood that the front and back central platforms my comprise either sections of a contiguous central platform piece that are exposed to view near the front and back ends of the exercise machine depending upon the positioning of the slideable carriage platform 106 on the rail structure 103, or may be physically separate pieces that are spaced apart longitudinally on the upper surface of the rail structure in proximity to the front and back ends of the exercise machine.

In the end view of FIG. 7, the longitudinal central platform is shown affixed to the upper surface of the rail structure 103 with only the back central platform 123 being visible. As seen in FIG. 7 and other Figures, the central platform preferably comprises a relatively narrow longitudinal structure. Preferably, the width of the central platform is less than the width of the stationary first and second end platforms and the slideable carriage platform. The width of the central platform can be the same as, slightly less than, or slightly greater than the width of the upper surface of the rail structure provided the width of the central platform provides sufficient support surface for an exerciser to perform exercises, does not cause the central platform to interfere with the slideable carriage platform moving freely on the rail structure, and the width of the rail structure is sufficient to provide adequate support for the central platform to stably support an exerciser. The width of the central platform need not be uniform from end to end. Rather, the width can be lesser in some sections and greater in others, for example as shown in FIGS. 1, 2A, 2B, and others. Thus, for example, the width of the central platform may be made relatively wider near the stationary first and second end platforms and in a mid-section and may be made relatively narrower in remaining sections as shown in FIGS. 2A and 2B.

The upper surface of the rail structure may itself comprise a substantially flat, planar surface which may comprise the central platform, or on which the central platform may be mounted. Alternatively, as shown in FIG. 7, the upper surface of the rail structure may comprise an elongated depression in which the central platform may be formed or mounted. In any event, it is preferred that the upper surface be such as to provide a substantially flat, planar, horizontal surface on which an exerciser may position one or more parts of the exerciser's body during exercise.

Preferably the central platform comprises a substantially flat, planar, horizontal top or upper surface on which an exerciser may position one or more parts of the exerciser's body during exercise. Also preferably, the upper surface is positioned at an elevation above the floor or other support surface that is lower than the substantially horizontal bottom surface of the slideable carriage platform 106, thereby providing for the slideable carriage platform to bridge beyond the edges of, and to roll over substantially the entire length of the longitudinal central platform during the performance of an exercise.

As can be readily seen, a longitudinal gap exists between the transversely opposed side edges of the back central platform 123 and adjacent longitudinal structures. The gap is enhanced by an impression or indent in the lateral sides of the longitudinal central platform. Preferably the gap and indent create a finger crawl channel 120 which comprises a finger grip which an exerciser may grasp to push or pull against while moving the slideable carriage platform in an exercise. Also preferably, the gap and indent extend a substantial length of the longitudinal central platform to enable an exerciser to grasp the central platform at a substantial number of locations. It will be understood that while a particular example of a finger grip has been described, the finger grip is not intended to be limited to the specific form described and may take many other forms that enable an exerciser to grip the central platform. By providing a finger grip for an exerciser, the exerciser may either stand upon or grasp with their hands the longitudinal central platform for performing various different exercises.

E. Platform Index Indicators and Mounting Platforms.

Figure 8:
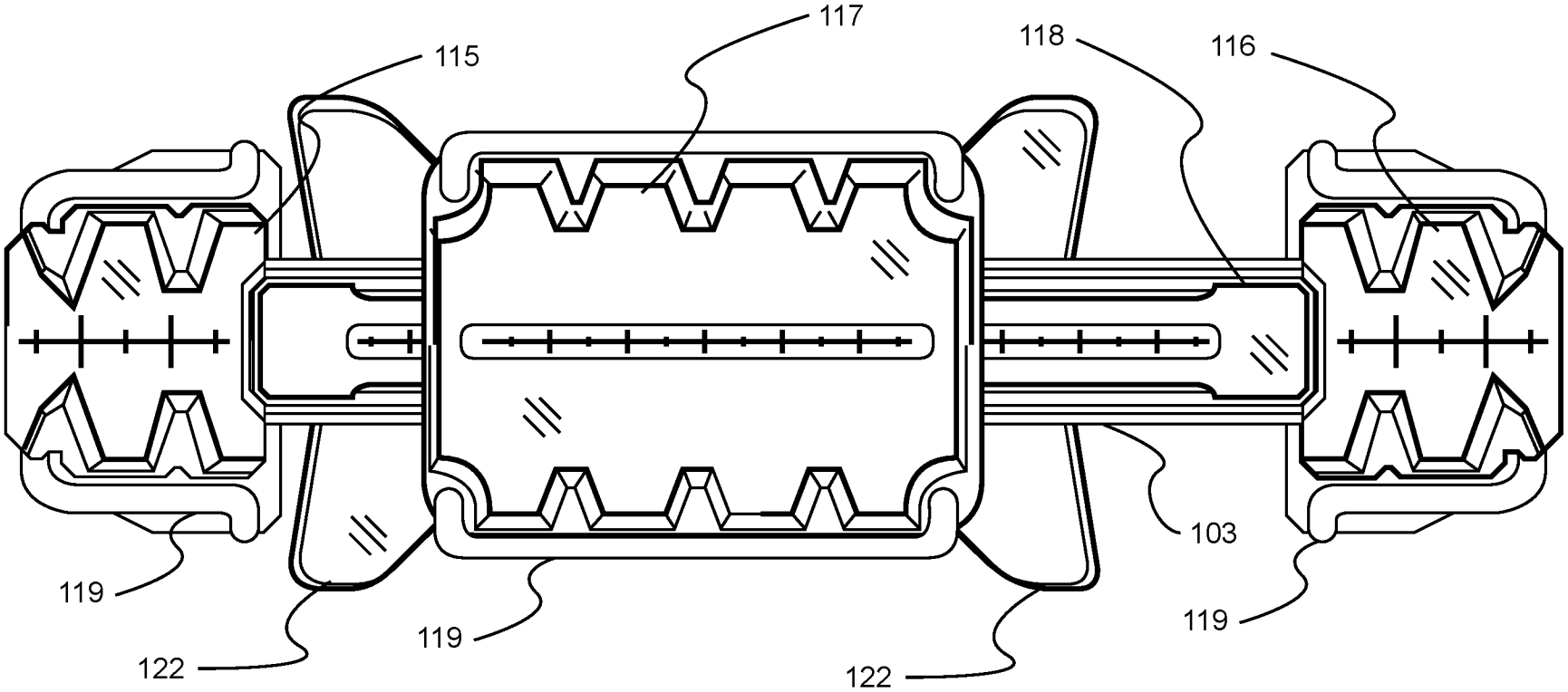
FIG. 8 a top view of a variation of an exercise machine with multiple exercise platforms in accordance with an example embodiment.
Figure 9:
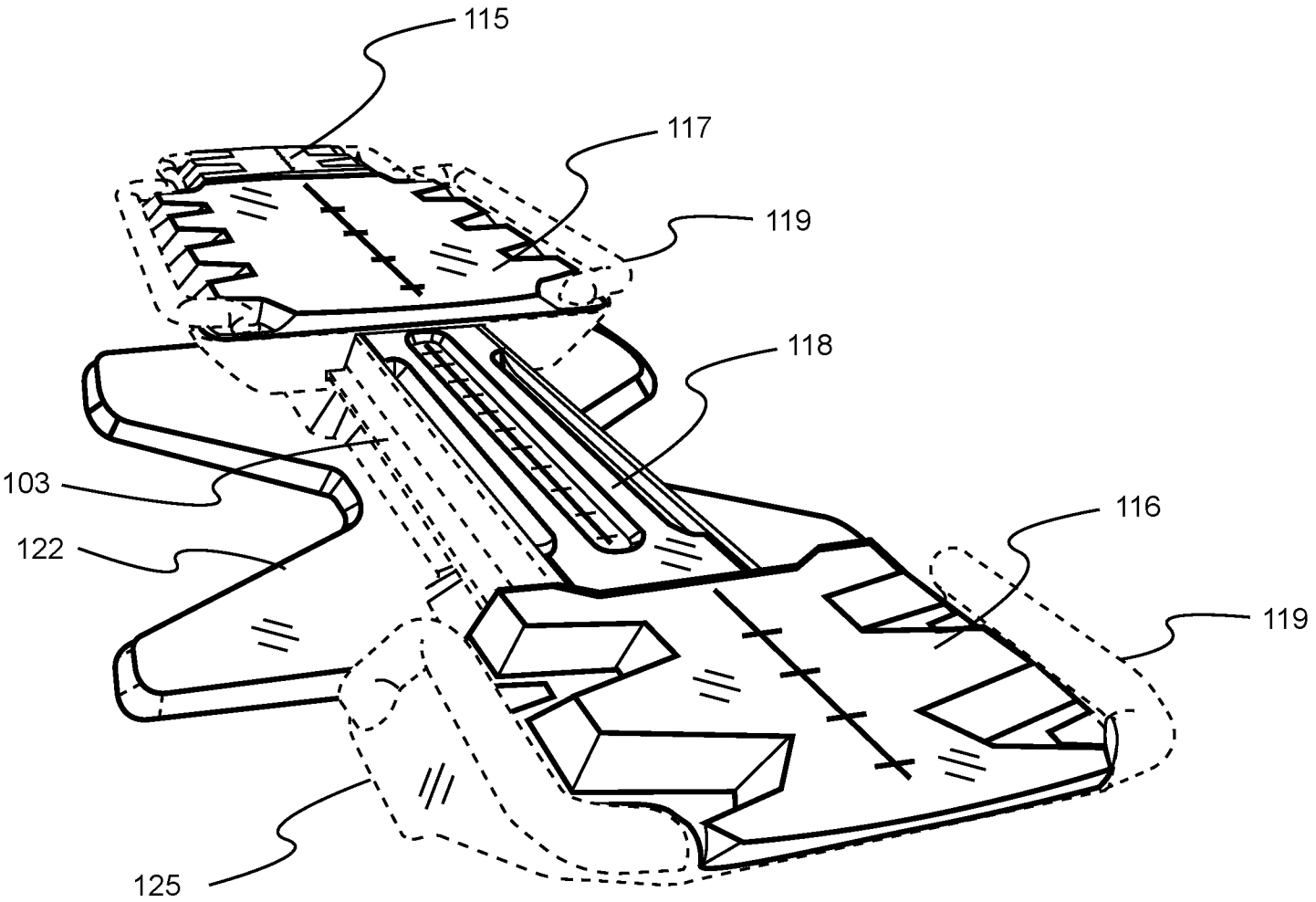
FIG. 9 is a perspective view of a variation of an exercise machine with multiple exercise platforms in accordance with an example embodiment.
Figure 10:
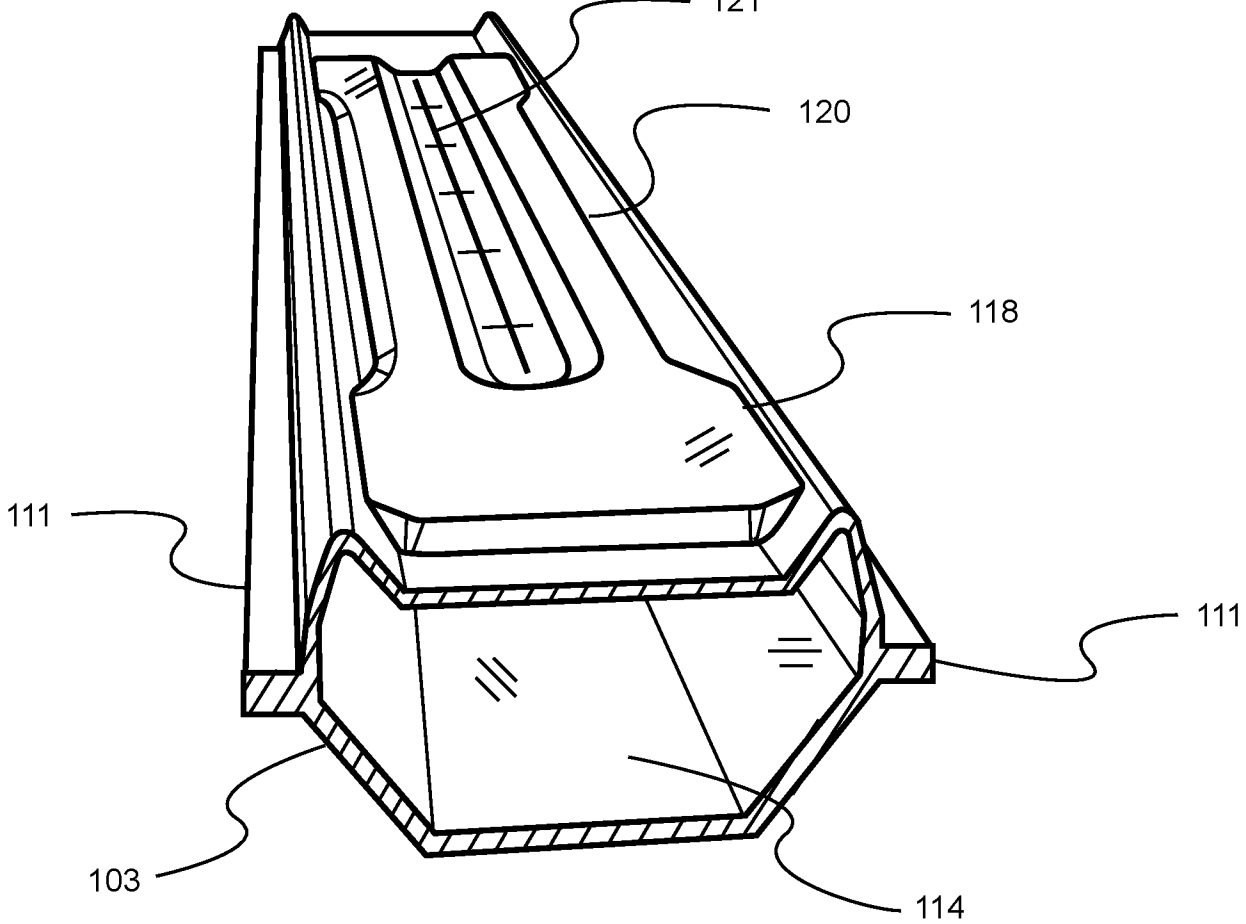
FIG. 10 is a perspective view of a center monorail structure and an exercise platform of an exercise machine in accordance with an example embodiment.

Referring primarily to FIGS. 8-10, a variation of an example exercise machine with multiple platforms incorporates index indicators or indices on the various exercise platforms and provides platforms to support an exerciser over substantially the entire length and width of the exercise machine. Although not shown specifically, the example machine shown in FIGS. 8-9 can be mounted on and supported by substantially the same frame and support components as described above with respect to the example machine shown in FIGS. 1-7.

Referring initially to FIG. 8 the variation of the example exercise machine comprises five substantive platforms. A plurality of the platforms together comprises a substantially continuous platform extending substantially the entire length of the exercise machine.

The variation of the example machine provides for a plurality of indexed exercise platforms. Specifically a plurality of longitudinally spaced index indicators or indices 121 is provided on the platforms so as to provide at least an indexed stationary front end platform 115, an indexed slideable carriage platform 117, an indexed stationary back end platform 116, and an indexed longitudinal central platform 118. The index marks on each of the platforms are preferably longitudinally aligned as well as being aligned from platform to platform. The indexed central platform is preferably secured to or formed integrally with the upper surface of a longitudinal rail structure 103 as best seen in FIG. 10 substantially as previously described. Preferably, the indexed central platform extends substantially the entire length between the indexed back end platform and indexed front end platform. Therefore, the front end platform, back end platform, and longitudinal central platform together create a new and novel continuous exercise surface of varying widths extending substantially the entire length of the exercise machine. Moreover, the longitudinally aligned index marks or indices on the platforms provide a substantially continuous set of spaced indices extending substantially the entire length of the exercise machine.

Various additional support surfaces are provided for use by exercisers, including platform hand rails 119. These are affixed to the opposed sides of the front and back end platforms 115, 116 and the slideable carriage platform 117.

The variation of the example exercise machine typically will find use in a class setting with other like machines located within an exercise facility. Class fitness training typically requires direction by a fitness instructor so that all exercisers properly perform the correct exercise in unison at the appropriate time. It is noted that in this setting, the index indicators or indices on each of the platforms may be referenced by an instructor to ensure that exercisers properly position themselves correctly on the appropriate platform(s) as directed.

Further, the variation of the example exercise machine just described is supported by a structural base in substantially the same manner as described previously, with each of the various platforms having top or upper surfaces comprising substantially horizontal planes. As described previously, the horizontal plane of the upper surfaces of the first end platform, second end platform, and slideable carriage platform is preferably at a first elevation above the level of the floor or other support surface of the machine while the horizontal plane of the upper surface of the central platform is preferably at a second elevation above the level of the floor or other support surface but below the first elevation. As a means of providing ease of mounting the elevated platforms of the machine by exercisers, a lower elevation enclosure of the structural base is provided that forms a separate mounting platform 122 with a separate mounting surface. Thus, the mounting surface of the mounting platform preferably will be at a third elevation above the level of the floor or other support surface and below the second elevation creating a step like progression of elevations to facilitate mounting and dismounting of the example exercise machine.

The mounting platform preferably comprises four mounting surfaces with a mounting surface being located at or near each of the first and second end platforms on opposite lateral sides of the machine. However, it will be appreciated that other arrangements of mounting surfaces may prove suitable depending on the details and use of the machine and the specific arrangement shown and described is not intended to be limiting. For example, only one mounting surface may be provided near a mid-point of the elongated exercise machine. Alternatively, a first mounting surface may be provided near the first end platform and a second mounting surface may be provided near the second end platform either on the same lateral side of the machine as the first mounting surface or on the opposite lateral side.

Referring to FIG. 9, a perspective view of the variation of the example exercise machine with multiple platforms provides a clearer presentation of the different elevations of the various platforms. So as to differentiate the many platforms of the multiple platform exercise machine from other non-platform components, cover shrouds 125, handles 119, the longitudinal rail structure 103, and other minor non-platform-related components are shown as dashed lines.

As illustrated in FIG. 9, the variation of the example machine comprises an indexed stationary front platform 115, an indexed slideable carriage platform 117, an indexed stationary back platform 116, and an indexed longitudinal central platform 118 secured to the longitudinal rail structure 103 and extending substantially the entire distance between the indexed back end platform and indexed front end platform.

As can be clearly seen, the indexed front end platform 115, indexed back end platform 116 and indexed longitudinal central platform 118 together create a new and novel continuously indexed, contiguous exercise surface of varying widths that extends substantially the entire length of the exercise machine. Further, the indexed slideable carriage platform 117 is slideable above substantially the length of the indexed longitudinal central platform 118, providing for indexable positioning of the indexed slideable carriage platform relative to the indexed longitudinal central platform.

As previously discussed, but not shown in FIG. 9, a resistance or biasing force preferably is exerted against the slideable carriage platform by one or more biasing members. The resistance or biasing force preferably has the characteristic of being of an increasing force relative to the length of deformation of the biasing member according to Hooke's law. Therefore, the indexable positioning of the slideable carriage platform relative to the longitudinal central platform is of considerable value when the distance that the slideable carriage platform moves against the force of a biasing member relative to the longitudinal central platform position is indicative of the energy an exerciser expends during an exercise.

Referring to FIG. 10, the longitudinal rail structure 103 and indexed longitudinal central platform 118 of the variation of the example machine are shown in a perspective view. As previously described, the rail structure comprises a center monorail structure having a substantially open structure cavity 114. Although not shown in FIG. 10, one or more biasing members preferably are installed within the cavity and connected between a stationary member of the rail structure and the slideable carriage platform in the same manner as previously described.

The rail structure has opposite lateral side surfaces and a pair of parallel trolley rails 111 are affixed to the opposite side surfaces and extend longitudinally along the lateral sides, substantially aligned with the central longitudinal axis of the rail structure, preferably for substantially the entire length of the rail structure. Although not shown in FIG. 10, but as described previously and as shown in FIG. 11, the slideable carriage platform is movably supported on the pair of trolley rails by a plurality of trolley wheels to reciprocate between the first and send end platforms over the indexed longitudinal central platform.

The rail structure has an elongated upper surface that comprises the indexed longitudinal central platform 118. The indexed longitudinal central platform 118 preferably is either formed integrally with the upper surface or is mounted and affixed to a substantially flat, planar, horizontal portion of the upper surface as shown in FIG. 10. The method of affixing the longitudinal central platform to the upper surface of the longitudinal rail structure may be accomplished using mechanical fasteners, hook and loop fastening materials or other known methods of attaching together dissimilar materials. The method of attachment is not meant to be limiting.

As previously described, the upper surface of the rail structure may itself be substantially flat, planar, and horizontal, or may include an elongated depression preferably with a substantially flat, planar, and horizontal bottom surface. In that case, the indexed central platform may be mounted and affixed to the upper surface of the rail structure within the elongated depression. In either event, it is preferred that the indexed central platform itself has an upper surface that is substantially flat, planar, and horizontal over a sufficient portion of the surface to provide stable and even support for an exerciser.

Index indicators or indices 121 are shown on a portion of the longitudinal central platform, preferably extending substantially the entire length of the platform, thereby providing reference points for positioning the slideable carriage platform above and relative to the indexed longitudinal central platform below. The index indicators or indices 121 may be formed on the preferably substantially flat upper surface of the central platform on which exercisers may position parts of their bodies during exercises. Alternatively, an elongated depression may be formed in the upper surface of the central platform and the indices may be recessed within the depression to avoid being worn or damaged due to repeated contact by exercisers.

Figure 11:
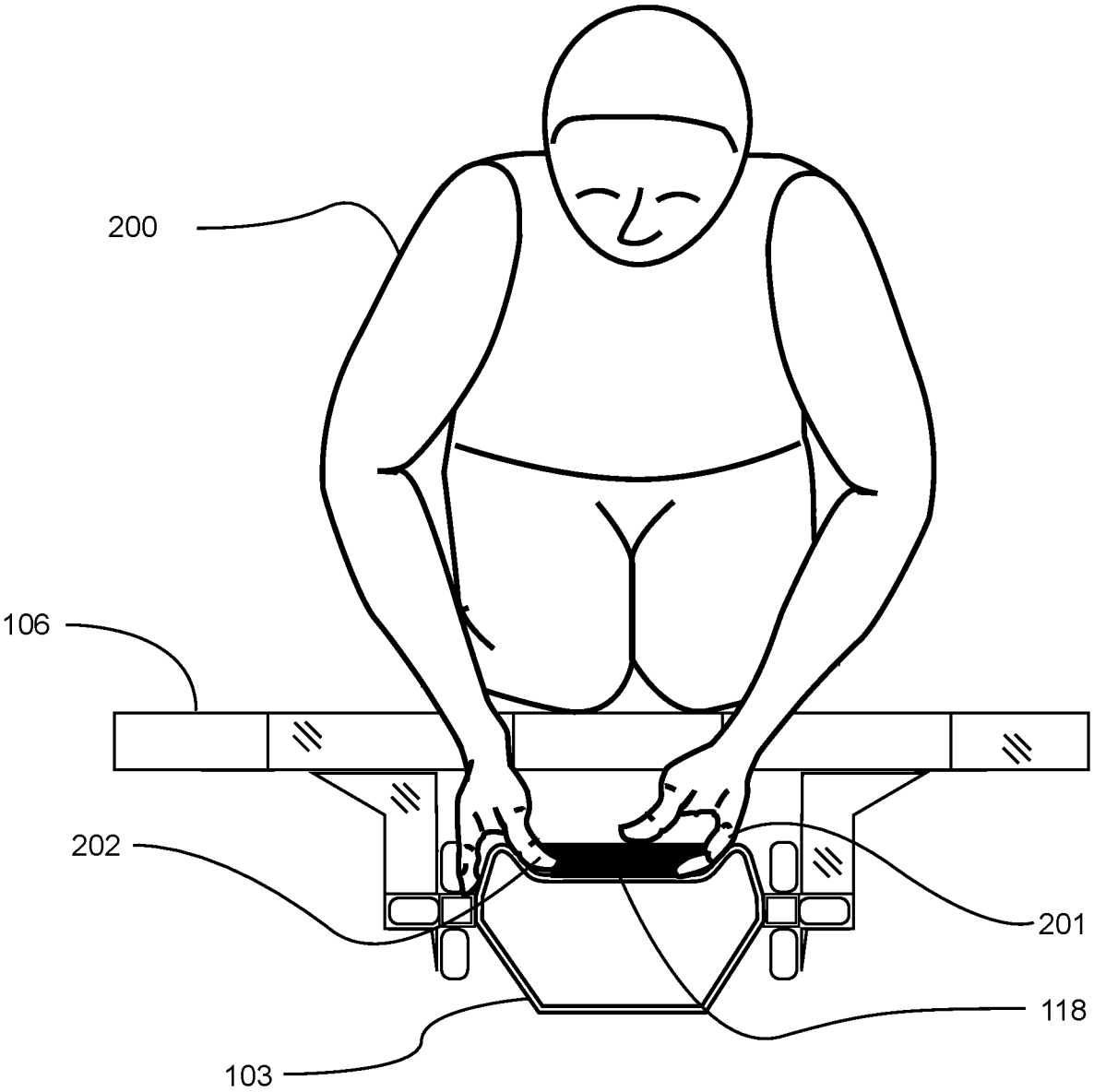
FIG. 11 is an end view showing an exerciser kneeling upon an exercise platform with the exerciser's hands placed proximate to an indexed longitudinal exercise platform of an exercise machine in accordance with an example embodiment.

Further, the indices may be used by an exerciser for determining positioning of their hands on the longitudinal central channel described as follows. The longitudinally extending opposed lateral side edges of the longitudinal central platform include an elongated recessed area that creates an elongated space, or gap, between the laterally opposed side edges of the longitudinal central platform and adjacent surfaces of the longitudinal rail structure. That space, the shape of which is best illustrated in FIGS. 7 and 11, is referred to as a finger crawl channel and comprises a finger grip for exercisers. In use, an exerciser may insert their fingers into the finger crawl channel to allow the hand to grasp the opposite lateral side edges of the longitudinal central platform so that the exerciser can apply an effective pulling or pushing force against the platform as may be preferred during the performance of certain exercises. The finger grip preferably extends longitudinally along the lateral sides of the central platform a sufficient distance to provide a plurality of potential gripping locations for exercisers. Various gripping locations can be indicated by reference to the indices 121.

FIG. 11 further illustrates the use of the finger grips on the longitudinal central platform as viewed from one end of the example exercise machine. An exerciser 200 is shown kneeling upon the slideable carriage platform 106 and grasping the opposite lateral sides of the longitudinal central platform 118. The longitudinal rail structure 103 and the longitudinal central platform 118 are shown in cross-section to better illustrate various placements of the exerciser's hands on the longitudinal central platform.

As may be preferred by the exerciser, the fingers 201 of the exerciser's hands may be placed into the finger crawl channel 120 as described in connection with FIGS. 7 and 10. When grasping the longitudinal central platform in this gripping variation, the exerciser's thumb rests substantially on the top medial surface of the longitudinal central platform as exemplified by the positions of the fingers of the exerciser's left hand. In one variation of using the finger crawl channel, for instance by exercisers with large fingers, the exerciser's thumb 202 may be placed within the finger crawl channel, with the fingers of the partially closed hand gripping the lateral side surface of the longitudinal rail structure 103 as exemplified by the positions of the fingers of the exerciser's right hand.

F. Operation of Preferred Embodiment

In use, an exerciser or instructor may first activate the actuators either together or separately to elevate one end and to tilt the plane of the exercise machine laterally on the universal joint as desired or appropriate for an exercise or exercises to be performed. An exerciser or instructor also may select one or more resistance biasing members to connect to the slideable carriage platform to apply a desired amount of resistance to the movable platform.

The exerciser may then mount the exercise machine by stepping up onto one or more of the mounting platforms. From there, the exerciser may position parts of the exerciser's body on one or more of the upper surfaces of the central platform, the first and second end platforms and the movable carriage platform as appropriate for the exercise(s) to be performed. The exerciser may refer to the index indicators on the central platform, first and second end platforms, and movable carriage platform to position the exerciser's body parts appropriately for each desired exercise. Alternatively, an exerciser may mount the exercise machine prior to adjusting the elevation and tilt, and selecting the desired biasing force. Obviously, however, caution should be taken in adjusting the exercise machine while an exerciser is mounted thereon in order to avoid falling as the exercise machine is in motion.

With the exercise machine adjusted as desired and the exerciser positioned appropriately, the exerciser may perform a wide variety of different exercises targeting various muscles and muscle groups without the need to change to one or more other machines. FIGS. 3-6 illustrate several different exercises an exerciser may perform and it will be appreciated that many more are possible.

By way of example, as shown in FIG. 3, the exerciser may stand facing a lateral side of the machine with the exerciser's right foot on the upper surface of the movable carriage and the left foot on the upper surface of a section of the central platform adjacent to the first end platform. In this position the exerciser's right foot is slightly elevated relative to the left foot and the right leg is slightly flexed compared to the left leg because the upper surface of the carriage is at a higher elevation than the upper surface of the central platform relative to the frame of the machine. The exerciser may then pull the right foot laterally toward the left foot using muscle force "F" to pull the movable carriage along the rail in a direction against resistance force "R" while maintaining the left foot in a fixed position on the central platform. Once the exerciser has moved the movable platform a required distance for the exercise, the exerciser may allow the movable platform to return to the starting position under the influence of the resistance force "R". The index indicators on the central platform may assist the exerciser in determining that the carriage has moved the required distance. The exerciser may then repeat the cycle as many times as desired.

By way of further example, as shown in FIG. 4, the exerciser may stand facing a lateral side of the machine with the exerciser's right foot on the upper surface of the second end platform and left foot on the upper surface of the movable carriage. The exerciser's right and left legs are slightly flexed by about the same amount because the upper surfaces of the second end platform and the carriage are at the same elevation relative to the frame of the machine. In this position, the exerciser may then push the left foot laterally outward with muscle force "F" to push the movable carriage along the rail over the central platform in a direction against the resistance force "R" while maintaining the right leg in a fixed position on the second end platform. Once the exerciser has moved the movable platform a required distance for the exercise, the exerciser may allow the movable platform to return to the starting position under the influence of the resistance force "R". Again, the index indicators on the central platform may assist the exerciser in determining that the carriage has moved the required distance, and the exerciser may repeat the cycle as many times as desired.

FIGS. 5 and 6 illustrate additional example exercises in which the exerciser faces the first end platform of the machine in a standing position (FIG. 5) or a kneeling position (FIG. 6). In the standing position, the exerciser positions the right leg on a section of the central platform adjacent the second end platform and the left leg on the movable carriage. In this position, the left foot is slightly elevated relative to the right foot and left leg is flexed slightly more than the right leg because the upper surface of the carriage is at a higher elevation than the upper surface of the central platform relative to the frame of the machine. In the kneeling position, the exerciser kneels on the movable carriage and positions the exerciser's right and left hands on the section of the central platform adjacent the first end platform. The exerciser may grip the central platform using the finger grips on its opposite lateral sides as illustrated in FIG. 11. In either the standing or kneeling position, the exerciser then applies force "F" from different muscle groups to move the carriage along the rail over the central platform in a direction against the resistance force applied to the carriage by the biasing members.

Upon completing a desired exercise or exercises, the exerciser may dismount from the machine by stepping onto one or more of the mounting platforms. From there, the exerciser may step down to the floor or other support surface on which the exercise machine rests.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine with multiple platforms, suitable methods and materials are described above. All publications, patent applications, patents, and other references mentioned herein are incorporated by reference in their entirety to the extent allowed by applicable law and regulations. The exercise machine with multiple platforms may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first end, a second end, and a rail extending between the first end and the second end of the frame;

wherein the rail has an upper surface and wherein the upper surface of the rail comprises a central platform configured to allow an exerciser to position a portion of a body of the exerciser upon the central platform during an exercise;

wherein the central platform comprises an elongated platform that extends along the upper surface of the rail;

a carriage movably positioned upon the rail between the first end and the second end;

wherein the carriage is movable on the rail over the central platform;

wherein the carriage has an upper surface, wherein the upper surface for the carriage is configured to allow the exerciser to position a different portion of the body of the exerciser upon the upper surface during the exercise;

a first end platform connected to the frame and positioned near the first end of the frame; and a second end platform connected to the frame and positioned near the second end of the frame.

2. The exercise machine of claim 1, wherein the central platform extends between the first end platform and the second end platform.

3. The exercise machine of claim 1, wherein the carriage has a first width, each of the first and second end platforms has a second width, and the central platform has a third width that is relatively narrower than the first width and the second width.

4. The exercise machine of claim 1, wherein the central platform has an upper surface and wherein the upper surface of the central platform is flat and planar.

5. The exercise machine of claim 1, wherein the central platform comprises a first lateral side and a second lateral side, wherein the first lateral side and the second lateral side each comprise a plurality of finger holds configured to be grasped by the exerciser during the exercise.

6. The exercise machine of claim 5, wherein each of the plurality of finger holds are comprised of an indentation.

7. The exercise machine of claim 6, wherein the indentation is elongated and extends along the first lateral side and the second lateral side of the central platform.

8. The exercise machine of claim 1, wherein the central platform comprises a first plurality of indexing indicators spaced apart to indicate a plurality of positions for the carriage relative to the central platform.

9. The exercise machine of claim 8, wherein the carriage comprises a second plurality of indexing indicators spaced apart to indicate a plurality of positions for the exerciser on the carriage.

10. The exercise machine of claim 9, wherein the first end platform comprises a third plurality of indexing indicators spaced apart to indicate a plurality of positions for the exerciser on the first end platform, and wherein the second end platform comprises a fourth plurality of indexing indicators spaced apart to indicate a plurality of positions for the exerciser on the second end platform.

11. The exercise machine of claim 1, wherein the upper surface of the carriage is at a first elevation relative to the frame, wherein the central platform has an upper surface, wherein the upper surface of the central platform is at a second elevation relative to the frame, and wherein the first elevation is greater than the second elevation.

12. The exercise machine of claim 1, comprising a first mounting platform supported on the frame.

13. The exercise machine of claim 1, wherein the central platform comprises a plurality of central platform segments spaced apart along the upper surface of the rail.

14. The exercise machine of claim 1, wherein the central platform extends for the entire length of the rail.

15. The exercise machine of claim 1, wherein the central platform is supported atop the upper surface of the rail.

16. The exercise machine of claim 15, wherein the upper surface of the rail comprises an elongated depression and the central platform is supported within the elongated depression.

17. The exercise machine of claim 1, wherein the central platform has a first end, a second end opposite the first end of the central platform and a central section between the first end and the second end of the central platform, wherein the central section of the central platform is narrower than the first end and the second end of the central platform.

18. The exercise machine of claim 1, wherein the central platform includes an elongated depression extending longitudinally with respect to the central platform.

19. An exercise machine, comprising:

a frame having a first end, a second end, and a rail extending between the first end and the second end of the frame;

wherein the rail has an upper surface and wherein the upper surface of the rail comprises a central platform configured to allow an exerciser to position a portion of a body of the exerciser upon the central platform during an exercise;

wherein the central platform has an upper surface and wherein the upper surface of the central platform is flat and planar;

a carriage movably positioned upon the rail between the first end and the second end;

wherein the carriage has an upper surface, wherein the upper surface for the carriage is configured to allow the exerciser to position a different portion of the body of the exerciser upon the upper surface during the exercise;

a biasing member configured to be connected to the carriage, wherein the biasing member is configured to apply a bias force upon the carriage;

a first end platform connected to the frame and positioned near the first end of the frame; and a second end platform connected to the frame and positioned near the second end of the frame;

wherein the carriage has a first width, each of the first and second end platforms has a second width, and the central platform has a third width that is relatively narrower than the first width and the second width.

20. An exercise machine, comprising:

a frame having a first end, a second end, and a rail extending between the first end and the second end of the frame;

wherein the rail has an upper surface and wherein the upper surface of the rail comprises a central platform configured to allow an exerciser to position a portion of a body of the exerciser upon the central platform during an exercise;

wherein the central platform is supported atop the upper surface of the rail;

wherein the central platform has an upper surface and wherein the upper surface of the central platform is flat and planar a carriage movably positioned upon the rail between the first end and the second end;

wherein the carriage has an upper surface, wherein the upper surface for the carriage is configured to allow the exerciser to position a different portion of the body of the exerciser upon the upper surface during the exercise;

a biasing member configured to be connected to the carriage, wherein the biasing member is configured to apply a bias force upon the carriage;

a first end platform connected to the frame and positioned near the first end of the frame; and a second end platform connected to the frame and positioned near the second end of the frame;

wherein the carriage has a first width, each of the first and second end platforms has a second width, and the central platform has a third width that is relatively narrower than the first width and the second width;

wherein the upper surface of the carriage is at a first elevation relative to the frame, wherein the central platform has an upper surface, wherein the upper surface of the central platform is at a second elevation relative to the frame, and wherein the first elevation is greater than the second elevation.

* * * * *